US005503410A

United States Patent [19]

Nielsen

[11] Patent Number: 5,503,410

[45] Date of Patent: Apr. 2, 1996

[54] WALKING ROCKING HORSE

[76] Inventor: Roger E. Nielsen, 515 E. 240 N., Salina, Utah 84654

[21] Appl. No.: 231,238

[22] Filed: Apr. 22, 1994

[51] Int. Cl.[6] ..... A63G 19/00

[52] U.S. Cl. ..... 280/1.182; 280/1.186; 280/1.206; 280/218

[58] Field of Search ..... 280/1.181, 1.182, 280/1.186, 1.183, 1.188, 1.191, 1.192, 1.196, 1.202, 1.204, 1.201, 1.206, 1.22, 1.23, 218; 472/100, 102; D21/70

[56] References Cited

U.S. PATENT DOCUMENTS

| | | | |
|---|---|---|---|
| 1,212,122 | 1/1917 | Wilkinson | 280/1.206 |
| 1,269,490 | 6/1918 | Murray et al. . | |
| 1,708,090 | 4/1929 | Hague . | |
| 2,421,091 | 5/1947 | Sylvester . | |
| 2,462,814 | 2/1949 | Rodriquez . | |
| 2,518,747 | 8/1950 | Bowker | 280/1.182 |
| 2,788,217 | 4/1957 | Patterson . | |
| 3,680,857 | 8/1972 | Bonvicini et al. . | |
| 3,724,872 | 4/1973 | Proctor et al. | 280/1.182 |
| 3,738,671 | 6/1973 | Czepiga . | |

FOREIGN PATENT DOCUMENTS

| | | | |
|---|---|---|---|
| 555524 | 7/1932 | Germany | 280/1.182 |
| 442347 | 11/1948 | Italy | 280/1.186 |

*Primary Examiner*—Mitchell J. Hill
*Attorney, Agent, or Firm*—Thorpe, North & Western

[57] ABSTRACT

A toy walking rocking horse. The toy horse includes a main body having a seat and a front leg member rigidly attached thereto. A head member shaped to simulate a head of a horse is mounted upon a front portion of the main body, with a pair of elongate handles extending laterally outward from the head in opposing directions. A rear leg member is pivotally attached to the main body at a pivot point such that the front leg member and the rear leg member are rotatable toward and away from each other about the pivot point. A rider may actuate the toy horse into a step-by-step forward progression by sitting upon the seat and alternately (i) rocking backward against the seat to rotate the main body and front leg member in the forward direction to a first forward-advanced position, and (ii) rocking forward against the handles and main body to shift weight of the rider off of the rear leg member to cause it to fall forward to a second forward-advanced position.

1 Claim, 2 Drawing Sheets

WALKING ROCKING HORSE

BACKGROUND OF THE INVENTION

1. The Field of the Invention

The present invention relates generally to a rocking horse toy, and more particularly to a recreation toy which is capable of being actuated by the rider to move along a floor in a forward direction.

2. The Background Art

Rocking horses of many varieties are known in the prior art. Perhaps the best known type of rocking horse is a toy horse having legs mounted on a pair of parallel arcuate rails. A child sits upon the horse and rocks back and forth in a rhythmic pattern, much like a person rocking in a rocking chair.

U.S. Pat. No. 3,680,857 (issued on Aug. 1, 1972 to Bonvicini et al.) teaches a toy rocking horse with the front legs mounted upon a first rocker member and the rear legs mounted upon a second rocker member. The use of two separate rocker members enables two separate rocking motions for purposes of exercise and coordination training.

Riding horse toys have been developed which are capable of actual travel. It was discovered to place wheels on the feet of a toy horse in combination with pedal mechanisms, spring-loaded actuating devices and other apparatus to impart motion to the wheels for forward movement. U.S. Pat. Nos. 2,788,217 (issued on Apr. 9, 1957 to Patterson), 2,462,814 (issued on Feb. 22, 1949 to Rodriquez), 2,421,091 (issued on May 27, 1947 to Sylvester), 1,708,090 (issued on Apr. 9, 1929), and 1,269,490 (issued on Jun. 1, 1918) disclose different wheeled toy horses which are capable of progressing from a first location to a second location. These toy horses do not rock and require complex mechanical apparatus to achieve forward progress, requiring additional expense to manufacture and increasing the possibility of mechanical failure.

A galloping horse toy is disclosed in U.S. Pat. No. 3,738,671 (issued on Jun. 12, 1973 to Czepiga). A spring-loaded galloping device is used to impart galloping motions to the legs of the horse to cause the horse to move in gallop-like steps. However, the internal mechanisms of this toy are even more complex than the wheeled horse toys discussed above.

Of current interest is a rider-actuated rocking horse toy which is simple in design and capable of selective forward progress by the rider.

OBJECTS AND SUMMARY OF THE INVENTION

It is therefore an object of the present invention to provide a rocking horse toy which is simple in design and operation.

It is an additional object of the invention to provide such a rocking horse toy capable of walking in steps in a forward direction in response to rocking motions of a rider.

The above objects and others not specifically recited are realized in a specific illustrative embodiment of a toy walking rocking horse. The toy horse includes a main body having a seat and a front leg member rigidly attached thereto. A head member shaped to simulate a head of a horse is mounted upon a front portion of the main body, with a pair of elongate handles extending laterally outward from the head in opposing directions. A rear leg member is pivotally attached to the main body at a pivot point such that the front leg member and the rear leg member are rotatable toward and away from each other about the pivot point. A rider may actuate the toy horse into a step-by-step forward progression by sitting upon the seat and alternately (i) rocking backward against the seat to rotate the main body and front leg member in the forward direction to a first forward-advanced position, and (ii) rocking forward against the handles and main body to shift weight of the rider off of the rear leg member to cause it to fall forward to a second forward-advanced position.

It will be appreciated that the present invention utilizes the advantages of first and second rigid members pivotally attached to each other. The first rigid member is the main body, seat, head, handles and front leg member, and the second rigid member is the rear leg member. The main body operates like a lever when a rider rocks back against the seat, which is advantageously positioned behind the pivot point of attachment of the two rigid members. This enables a rider to actually ride the toy in the forward direction by simply rocking back and forth, and eliminates the need for wheels and complex movement-inducing devices.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawing in which.

DETAILED DESCRIPTION OF PRESENTLY PREFERRED EMBODIMENTS

Figure 1:
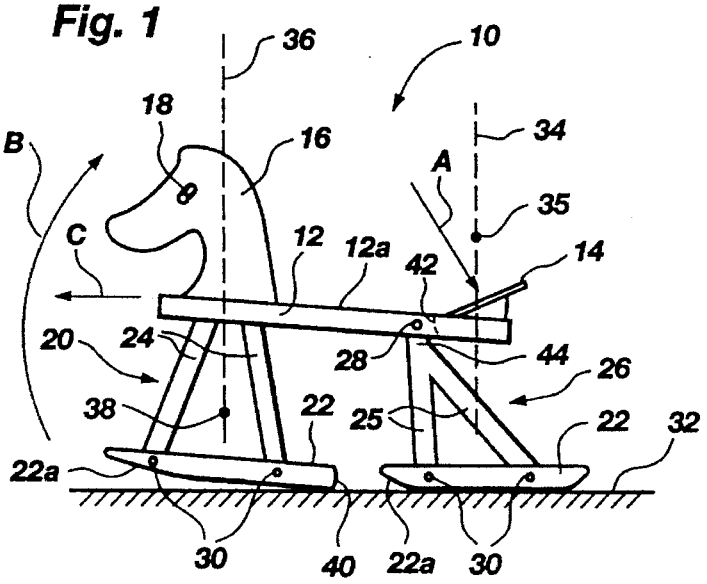
FIG. 1 illustrates a side view of a toy horse in a first forward-advanced position, made in accordance with the principles of the present invention.

Reference will now be made to the drawings wherein like structures will be provided with like reference numerals.

Figure 2:
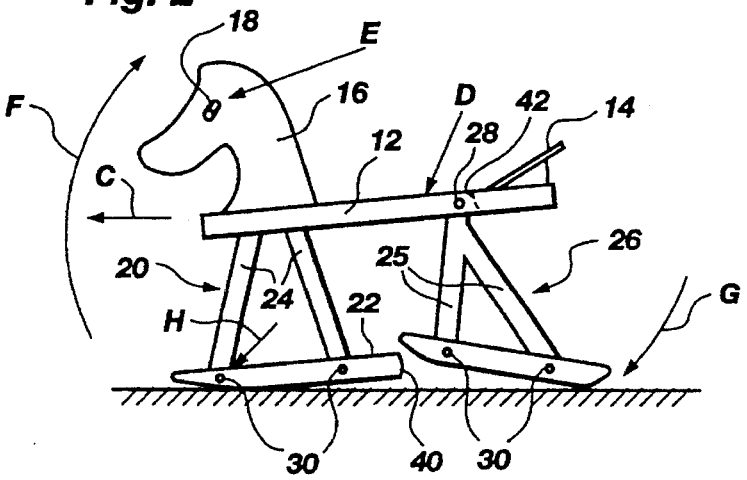
FIG. 2 illustrates a side view of the toy horse of FIG. 1 in a second forward-advanced position.

Referring now to FIG. 1, there is shown a toy horse generally designated at 10. A main body 12 includes a seat 14 or other suitable rider support means disposed on an upper surface **12*a* of the main body. A head member 16 shaped to simulate a head of a horse is mounted upon a front portion of the main body 12. A pair of elongate handles 18 extending laterally outward from the head 16 in opposing directions. A front leg member, generally designated at 20, is rigidly attached to the main body 12. The front leg member 20 includes a pair of parallel rails or other suitable support surface 22 rigidly intercoupled with the main body 12 by columns 24. A rear leg member, generally designated at 26, is pivotally attached to the main body 12 at a pivot point of attachment 28. The rear leg member 26 also includes a pair of parallel rails 22 supported with columns 25, the columns being attached to the pivot point 28. As shown in FIGS. 1–2, at least one of the columns 25 is substantially straight and includes top and bottom ends and a central axis which is substantially common with the pivot point 28. The rails 22 are preferably formed to include curved lower surfaces 22***a* to enhance rocking motions of the toy horse 10, although the lower surfaces of the rails may be substantially planer if desired. The rails 22 are preferably attached to lower ends 24*a* of the columns 24 by brace members 30, shown most clearly in FIG. 4. The rails 22 provide lateral support to the toy horse 10 to thereby maintain the toy horse in an upright position. It is to be understood that each set of parallel rails 22 may be replaced with any suitable support platform, such as a single wide member suitable for providing sufficient lateral support.

The toy horse 10 is rider-actuated upon a floor 32 or other stable surface. It will be appreciated that the pivot point 28 is located between (i) a vertical plane 34 passing through at least a portion of a rider (not shown) when the rider is supported upon the seat 14, and (ii) at least a portion of the front leg member 20. The pivot point 28 is most preferably located between (i) a vertical plane 34 passing through a center of mass 35 of the rider when said rider is supported upon the seat 14, and (ii) a vertical plane 36 passing through a center of mass 38 of the front leg member 20. It will be appreciated that when the pivot point 28 is positioned as described, the main body 12 and its attachments (i.e. head member 16 and front leg member 20) can be selectively pivoted forwardly and in the rotational direction shown at arrow B by applying pressure to the seat 14. The significance of this feature will be described in more detail below.

A rider (not shown) may ride the toy horse 10, preferably in the following manner. The rider sits upon the seat 14, and may choose to grasp the handles 18 and rest his or her feet upon the forward-most brace members 30. By rocking backward and against the seat 14 in the direction shown by arrow A, the rider may selectively cause the front leg member 20 to rotate relative to the rear leg member 26 in the direction B, which also causes a forward displacement of the front leg member 20 in the forward direction as shown by arrow C to a first forward-advance position as in FIG. 1. The seat 14 is preferably positioned behind the pivot point 28 so as to extend outward from the main body 12 in an upward direction at an angle relative to the main body.

Referring now to FIG. 2, the rider may then rock forward to shift his or her center of mass 35 forwardly to thereby shift weight off of the rear leg member 26 and onto the main structure as at E (with the rider's hands gripping the handles 18) at D (with the rider's body against the main body 12) and/or at H (with the rider's feet). This forward rocking motion reverses rotational motion of the front leg member 20 to a direction F and operates to focus a substantial portion of the rider's weight into the front leg portion 20. The redistribution of the rider's weight permits the rear leg member 26 to fall pivotally forward to a second forward-advanced position as shown in FIG. 2, with a pivot motion shown by arrow G about the pivot point 28. It will thus be appreciated that a rider may advance the toy horse 10 in the forward direction C by alternately rocking back and forth with intuitive, rhythmic motions. It is to be understood that the rider may cause the toy 10 to advance forwardly as described without necessarily contacting the seat 14, or the handles 18, or the forward-most brace member 30. It is the shifting of the center of mass 35 of the rider as part of a rocking motion, and the resulting redistribution of the rider's weight through the structure of the toy 10, which causes forward progress of the toy. It will be appreciated that such rocking and shifting may be accomplished without touching the handles 18, or the foot rest/forward brace member 30.

It is to be understood that the rear leg member 20 need not be pivotally mounted, but may be rotatably connected to the main body 12 in any suitable manner, provided the rear leg member 26 is rotatable relative to the front leg member 20 about a pivot point positioned as described above. The positional terms "forward", "backward", "in front of" and "behind" are used herein according to traditional usage and in reference to the forward direction C. For example, the seat 14 is behind the pivot point 28, and the handles 18 are in front of the pivot point 28.

It is preferable to have all of the components of the toy horse 10 rigidly interconnected as part of a one-piece integral support structure, except for the rear leg member 26 being pivotally attached. However, alternative embodiments utilizing, for example, a front leg member which is independently rotatable relative to the main body 12 are within the scope of the present invention.

Figure 4:
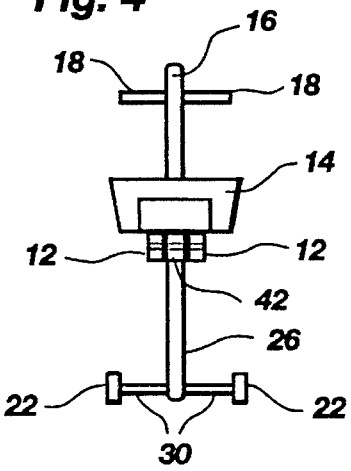
FIG. 4 illustrates a rear view of the toy horse of FIGS. 1–2.

The toy horse 10 further includes stopping means for limiting rotational movement of the front and rear leg members 20 and 26. A rear end 40 of the front rails 22 operates as a suitable second stopping member in that it contactably receives the rails 22 of the rear leg member 26 to thereby limit rotational movement of the rear leg means 26 in the forward direction. A stopping block 42 operates as a suitable first stopping member in that it moves into contact with a rear portion of the rear leg member 26 during rotation of the main support structure in the direction of arrow B to thereby block rotational movement of the main support structure (and thus the front leg member 20) beyond a certain point in the forward direction. The stopping block 42 is preferably positioned on the main body 12 substantially adjacent to and behind a proximal end 44 of the rear leg member 26, as shown in FIGS. 1–2 and 4.

Figure 3:
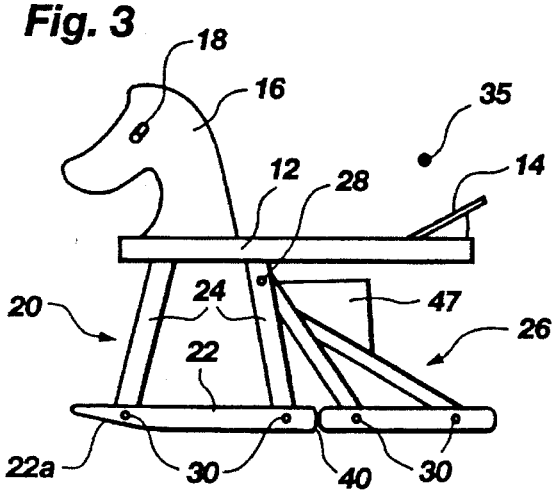
FIG. 3 illustrates a side view of an alternative embodiment of the toy horse of FIGS. 1–2.

Referring now to FIG. 3, it will be appreciated that many alternative embodiments of the toy horse 10 are within the scope of the present invention. For example, the rear leg member 2 need not be attached to the main body 12, but may instead be pivotally mounted to a portion of the front leg member 20 as shown at 60 in FIG. 3. The pivot point 64 in FIG. 3 is still positioned in front of the rider to enable the rider to pivot the front leg member 20 in the forward direction as described above. A stopping block 47 is disposed on the rear leg member 60 to block rotational movement of the main support structure relative to the rear leg member beyond a certain point.

Figure 5:
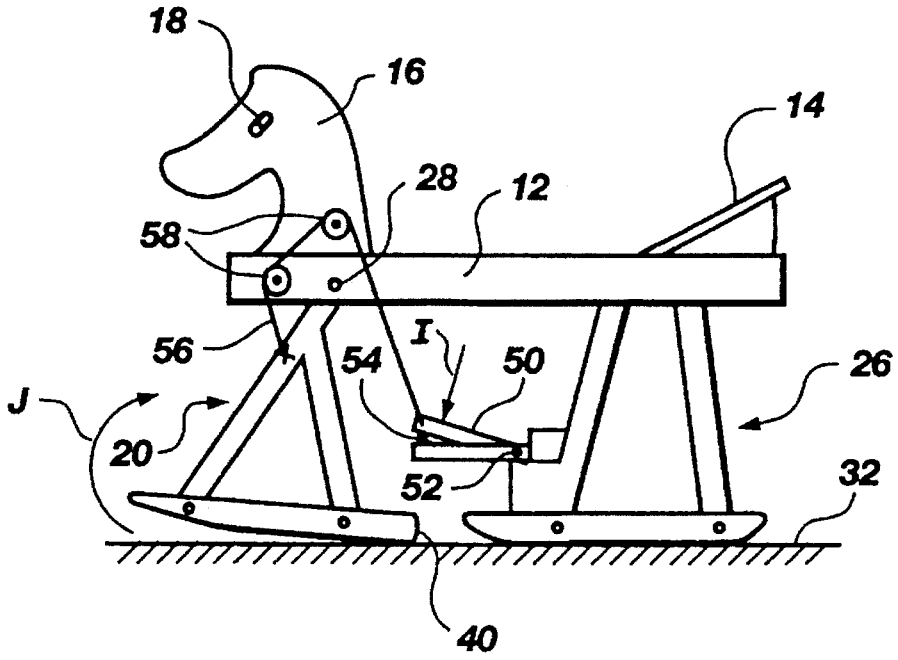
FIG. 5 illustrates a side view of another alternative embodiment of the toy horse of FIGS. 1–2, in a first forward-advanced position.
Figure 6:
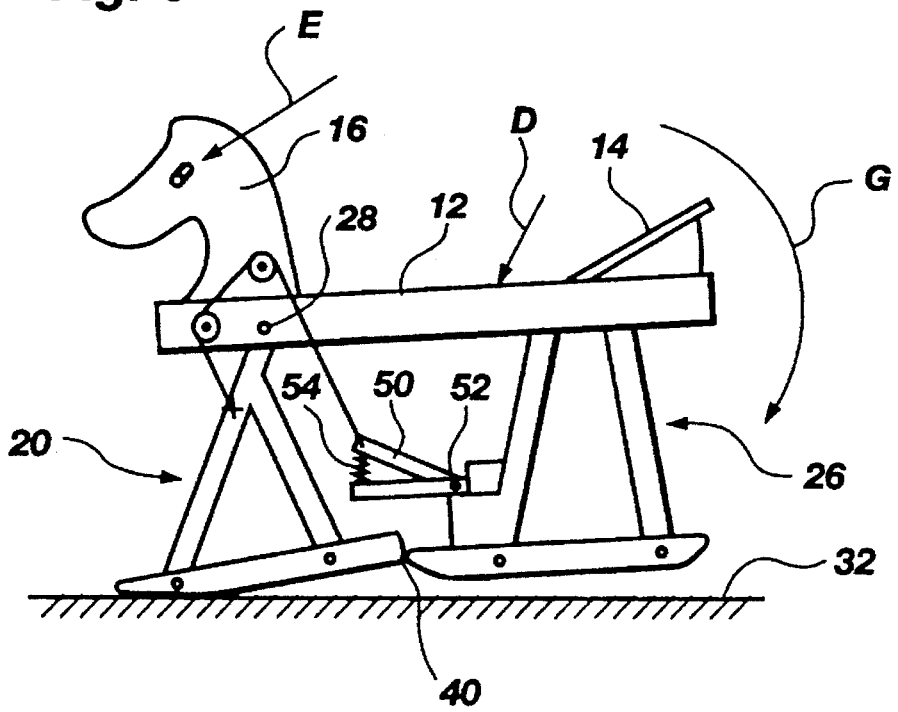
FIG. 6 illustrates a side view of the toy horse of FIG. 5 in a second forward-advanced position.

Referring now to FIGS. 5–6, it will be appreciated that the front leg member 200 can be rotatable with the rear leg member 62 being fixed to the main body 12. The front leg member 200 can be caused to rotate by utilizing a number of different devices. The following non-limiting embodiment is one way of accomplishing forward progress. A spring-loaded foot pedal 50 is pivotally attached at 52 and is mounted upon a spring member 54. The foot pedal 50 is intercoupled to the front leg member 200 with a cable 56 which extends around pulleys 58. When the rider pushes downward upon the foot pedal 50 in the direction of arrow I, the cable 56 is caused to pull upon the front leg member 200 to rotate the front leg member in the direction of arrow J to a first forward-advanced position as shown in FIG. 5. The user may then rock forward by exerting against the toy 10 as described earlier in conjunction with FIG. 2 (i.e. by leaning into the handles 18 in the direction E and/or leaning into the main body 12 in the direction D) to shift weight off of the rear leg member 62, permitting the main support structure (and thus the rear leg member 62) to fall rotatably forward in the direction of arrow G about the pivot point 66 to a second forward-advanced position as shown in FIG. 6.

It is to be understood that other front-leg shifting devices may be used instead of the spring-loaded foot pedal 50, including hand-held actuating members such as oars or handle bars operably connected to the front leg member 20 so as to permit selective rotation thereof. According, the term "front-leg shifting means" as used herein shall be interpreted to include any suitable method for accomplishing rotation of the front leg member 20. Of course, the front leg member 20 need not be pivotally attached as in FIGS. 5–6, but may instead by rotatably attached to the main support structure in any suitable manner.

The present invention represents a significant advance in the field of ridable toy horses. It is noted that many of the advantages of the present invention accrue from the aspect of rear leg means rotatably attached to a rigid, integral support structure, wherein the pivot point is located in front of at least a portion of the rider. The disadvantages in the prior art noted above and others not discussed are overcome to a significant degree by the present invention. Those skilled in the art will appreciate from the preceding disclosure that the objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A rider-actuated rocking toy adapted to move in a forward direction in response to rocking motions of a rider supported thereupon, said rocking toy comprising:

support structure including a downwardly-extending front leg member, said support structure further including a forward half and a rearward half, said rearward half including a seat, wherein the support structure further includes an elongate body;

a rear leg member comprising a straight support member having a top end and a bottom end, said support member being rotatably mounted at the top end to a pivot point on the rearward half of the support structure and extending downward therefrom to the bottom end; and at least one support surface secured to the bottom end of the support member for providing lateral support to the support structure and rear leg member; and a seat member disposed on the elongate body in a position behind the pivot point and extending outward therefrom in an upward direction to thereby define a sitting surface positioned at upward angle relative to the body.

* * * * *